United States Patent [19]

Livesay

[11] 4,210,292

[45] Jul. 1, 1980

[54] IMPACT ROCK CRUSHER

[75] Inventor: Richard E. Livesay, Peoria, Ill.

[73] Assignee: Caterpillar Tractor Co., Peoria, Ill.

[21] Appl. No.: 942,832

[22] Filed: Sep. 15, 1978

[51] Int. Cl.[2] ..... B02C 1/02

[52] U.S. Cl. ..... 241/148; 241/264

[58] Field of Search ..... 241/134, 139, 147, 148, 241/198 R, 262, 264

[56] References Cited

U.S. PATENT DOCUMENTS

| | | | |
|---|---|---|---|
| 2,296,088 | 9/1942 | Carter | 241/148 |
| 2,487,744 | 11/1949 | Waters | 241/148 |
| 3,868,145 | 2/1975 | Cobb et al. | 37/DIG. 18 |

*Primary Examiner*—Richard B. Lazarus

*Attorney, Agent, or Firm*—Wegner, Stellman, McCord, Wiles & Wood

[57] ABSTRACT

A rock-crushing apparatus is provided with a stationary annular member in which a rock-crushing mechanism is supported. The rock-crushing mechanism has at least two pivoted rock-crushing shanks which are successively impacted by an eccentrically mounted member. The eccentrically mounted member is rotatably driven by a motor and flywheel assembly. The shanks may be biased outwardly so as to trap rocks between the shanks and the stationary member whereupon the successive impacts from the eccentrically mounted member progressively crushes said rocks.

10 Claims, 4 Drawing Figures

IMPACT ROCK CRUSHER

BACKGROUND OF THE INVENTION

1. Field of the Invention

This invention relates to rock-crushing apparatus and, more particularly, to multiple moving crushing members powered by a single energy source.

2. Description of the Prior Art

Rock-breaking and rock-crushing mechanisms have generally been provided with a stationary annular crushing member or concave, in which is mounted a gyratory crushing member or head, which crushing member or head, as it gyrates, crushes rock trapped between the head and the concave. Various mechanisms have been provided for creating the gyratory motion to the crushing head so as to appropriately crush the rocks loaded into the concave. Due to the forces required to crush the rock, the gyratory mechanism is subjected to frequent failure. In addition, the mechanism used to create the gyratory motion is subjected to shock and vibration which affects its ability to operate and, in fact, causes its deterioration and failure over a relatively short period of time.

SUMMARY OF THE INVENTION

The present invention is directed to overcoming one or more of the problems as set forth above.

A rock-crushing mechanism is provided which has two or more movable crushing members or shanks powered by a single energy source so as to effect the crushing or rock as it passes between a concave and the movable crushing members or shanks of the apparatus. The crushing members or shanks are successively driven outwardly to effect the impact for crushing the rock. Provision is made for replacing the lining of the concave and the impacting surfaces of the crushing members or shanks when worn.

BRIEF DESCRIPTION OF THE DRAWING

The details of construction and operation of the invention are more fully described with reference to the accompanying drawing which forms a part hereof and in which like reference numerals refer to like parts throughout.

In the drawing.

DESCRIPTION OF THE PREFERRED EMBODIMENT

Figure 1:
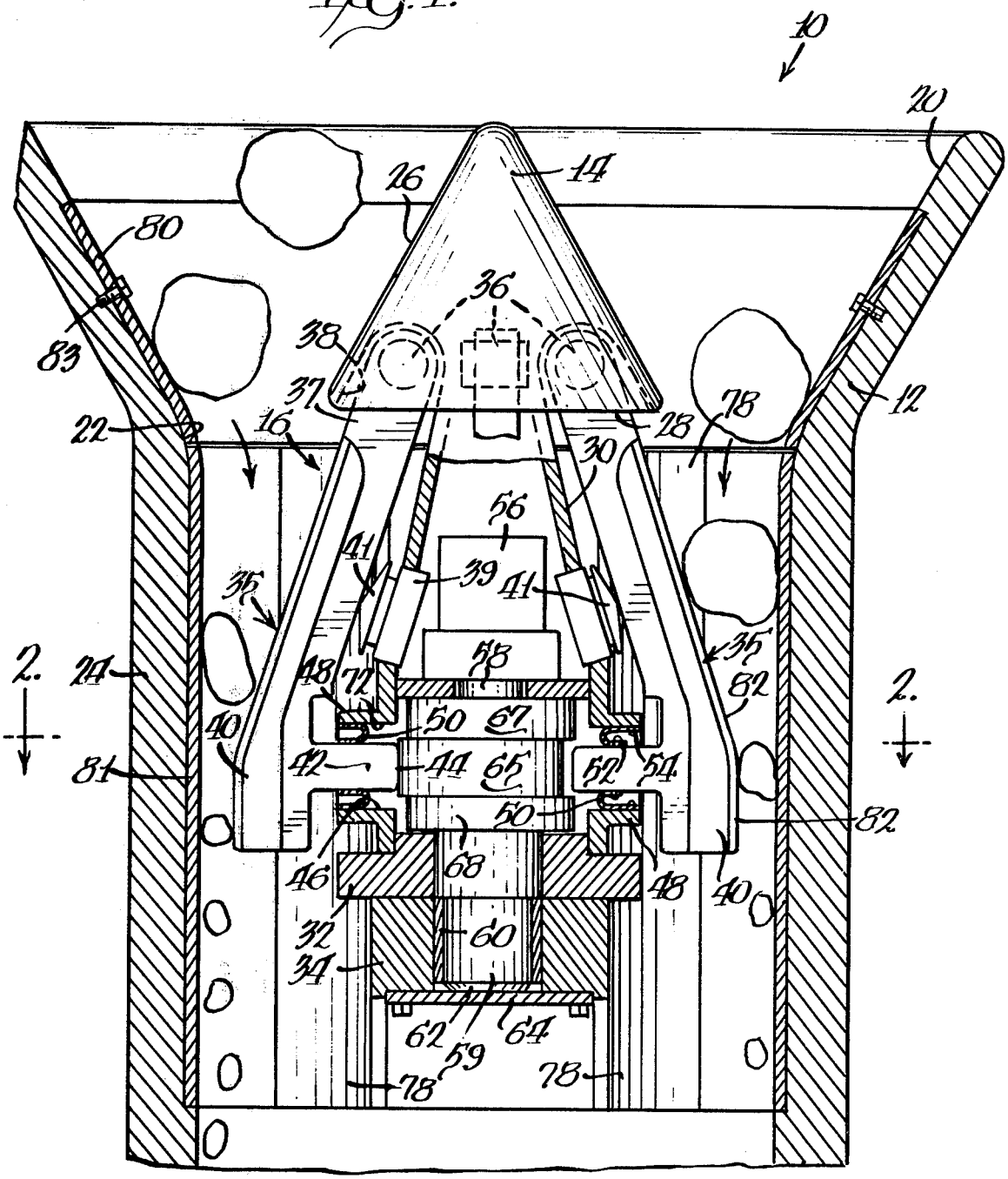
FIG. 1 is a cross-sectional view taken along a vertical plane through the midportion of the improved rock-crushing apparatus.
Figure 2:
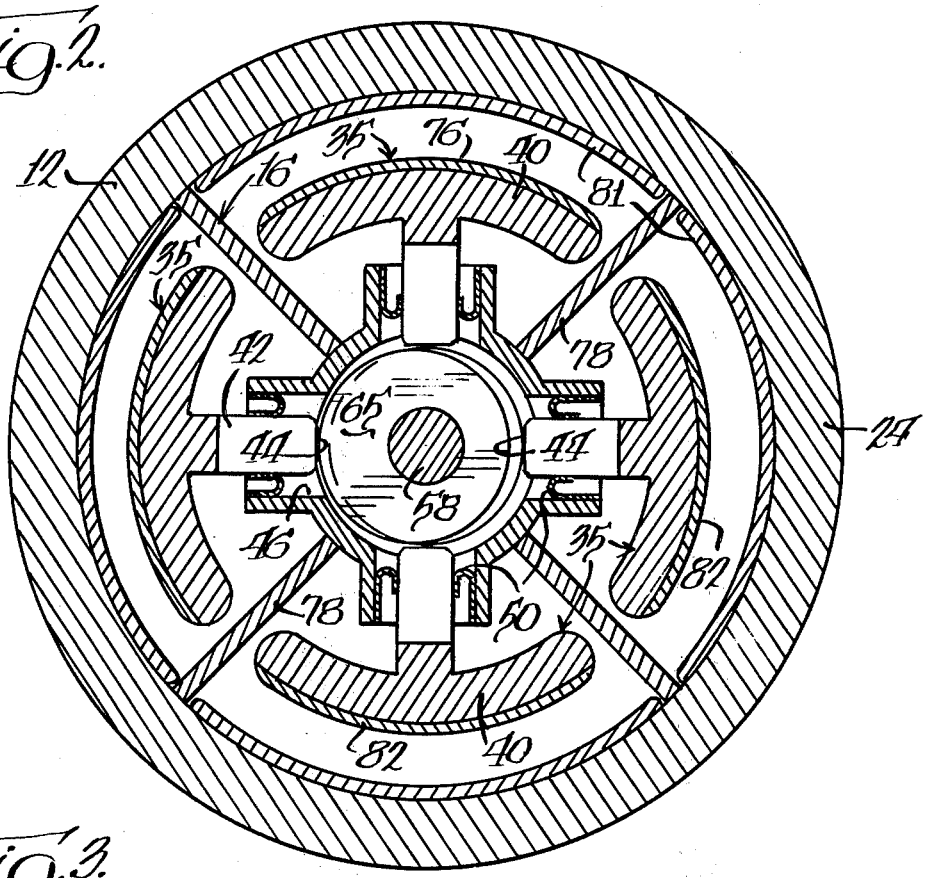
FIG. 2 is a cross-sectional view taken along the line 2—2 of FIG. 1.

Referring to the drawing, reference numeral 10 designates a rock-crushing apparatus which is comprised of a stationary crushing member or concave 12 and a central stationary cone-shaped material divider 14 supported midway between the sides of the concave by a spider 16 mounted on the concave. The spider 16 has as much open space between the webs of the spider as is possible to permit material to flow therethrough without obstruction. FIGS. 1 and 2 illustrate the crushing member or concave 12 as being annular in shape, it is to be understood that the crushing member could be square, rectangular, or the like without departing from the invention.

The stationary crushing member or concave 12 is funnel-shaped, having an enlarged open end 20 which tapers to a throat 22 joined with a cylindrical portion or neck 24. The cylindrical portion 24 has walls lying substantially vertical. The stationary cone-shaped material divider 14 has a cone portion 26 located substantially centrally with respect to the sloped or tapered open mouth 20 of the concave 12. The cone portion 26 has an overhanging part 28 to which is joined a hollow tubular body portion 30 which, in turn, supports a thrust member 32 and a bottom bearing plate 34. The member 32 and plate 34 are removably secured to the body portion 30.

In the form of invention shown in FIGS. 1 and 2, four elongate crushing members or shanks 35 are pivotally connected by pins 36 at the upper ends 37 thereof in recesses 38 formed in the cone portion 26 of the divider. The shanks 35 pivot about the axis of pins 36 so that the lower end portions or hammers 40 move radially outwardly from the axis of the divider 14. An inwardly extending rod or impact member 42 is formed integrally with the inner surface of the lower end portion or hammer 40, which impact member 42 has a flat or slightly concaved, inwardly facing contact surface 44 thereon. The rods or impact members 42 of the four shanks 35 extend through openings 46 defined by flanges 48 on the side walls of the body portion 30 of the divider 14. Seals 50 are provided between the impact members 42 and the walls of the openings 46 in the body 30 so as to prevent dirt and the like from getting into the operating mechanism in body 30, and to retain lubricants and the like in the body 30. The seals 50 may be doughnut-shaped members encircling the impact member 42, and are attached to the impact member at 52 and to the walls of the openings 46 at 54. The seals 50 permit the impact members 42 to be driven radially outwardly and return without interference. This is accomplished by means of the resilient seals rolling and unrolling relative to the impact members 42 and relative to the openings 46 in the divider. Other forms of seals may be provided without departing from the spirit of the invention. Each shank 35 is biased outwardly by a biasing member 39 which is seated in the walls of the body portion 30 and has a resiliently biased contact 41 extending outward into contact with the shank 35. The biasing member 39 also serves as a dampening member, whereby the rebound of the shank after impacting the rocks is dampened by the biasing elements of the member 39.

Mounted inside the body portion 30 of the divider 14 is a motor 56, which may be electric or hydraulic, with the output thereof connected to a shaft 58, the lower end 59 of which is supported in the sleeve bearing 60 in the bearing plate 34 and in the thrust member 32. A thrust bearing 62 is urged against the end 59 of the shaft by the cap 64 which is bolted on the plate 34. The plate 34 and member 32 can be removed from body 30 to provide access for servicing the shaft and the operating mechanism in the body 30. An enlarged eccentric 65 is carried by the shaft 58 with a pair of flywheels 67,68 connected to the shaft on either side of said eccentric. The flywheels 67,68 are concentrically mounted with respect to the axis of the shaft so that rotation of the shaft 58 by the motor will rotate the flywheels 67,68 and the eccentric 65. The flywheels 67,68 and eccentric 65 may be of the type shown and described in U.S. Pat. No. 3,868,145 in the names of Cobb et al and assigned to the common assignee of the present application. The flywheel and eccentric arrangement of the U.S. Pat. No. 3,868,145 is one form of drive arrangement for this system, other drive arrangements being possible.

The eccentric 65 is mounted so that the enlarged diameter portion 70 extends into a cylindrical channel 72 formed in the body portion 30 of the divider 14 with the enlarged portion 70 of the eccentric engaging the surface 44 of one impact member 42 of one shank 35 at a time. As the eccentric 65 rotates about the axis 74 of the shaft 58, each shank 35 will be successively driven outwardly to reduce the space between the hammer portion 40 of the shank 35 and the inner surface of the concave so as to crush any rock located therebetween. The eccentric 65 then moves on to the next shank 35 and delivers the same kind of crushing blow to the shank 35 so as to crush rock disposed between the hammer 40 of the shank and the concave. It is clear that the power of the motor 56, flywheels 67,68 and eccentric 65 arrangement must be sufficient to allow for the successive blows that must be rendered by the eccentric 65 to the successive shanks 35 about the periphery of the divider 14.

It will be noted in FIG. 2 that each shank 35 has an enlarged hammer portion 40 which has an outer surface 76 that substantially conforms to the shape of the inner surface of the cylindrical portion 24 of the concave 12 so that substantially an enlarged area of rock can be crushed with each activation of a shank 35. In the form of invention shown in FIG. 2, the tips of the successive hammers 40 are relatively close together so that the webs 78 of the spider 16 for supporting the divider 14 can be located in the space between adjacent hammers 40, which webs 78 will act as subdividers to force the rock into proper position for crushing.

It is contemplated that removable liners or surfaces 80,81 and 82 can be provided on the concave 12, neck 24 and on the hammers 40, respectively, which liners can be replaced after they have exhibited sufficient wear. The abrasive and deteriorating effect of the blows of the hammers 40 on the rocks will wear away the surfaces of the concave 12 and of the shanks 35 so that repair and replacement of the surfaces become necessary. The liners 80 in the funnel-shaped portion 20 are shown radial in configuration and may be bolted as by bolts 83. The liners 81 may be elongate and lie parallel to the axis of the neck 24 and, likewise, may be bolted in place. The liners 82 may be bolted to the face of the hammer portions of the shank 40. In place of the bolted on liners 80,81,82, the wear surfaces may be hand surfaced or the like.

Figure 3:
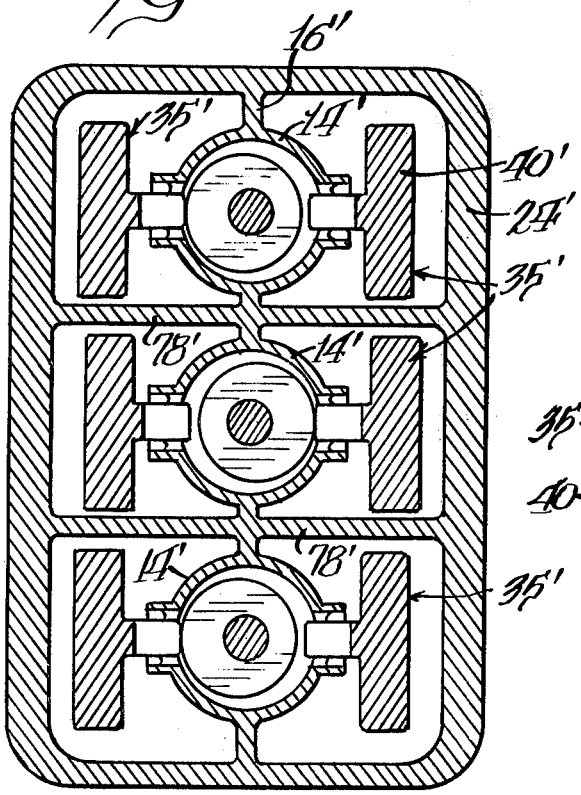
FIG. 3 is a cross-sectional view taken along the line 3—3 of FIG. 1 only showing a modified form of rock-crushing mechanism.
Figure 4:
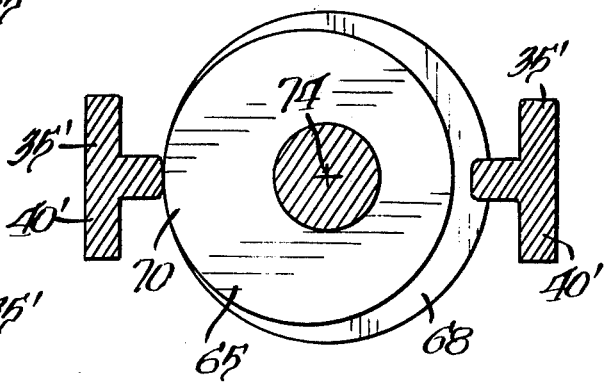
FIG. 4 is a cross-sectional view showing the relative location of a pair of shanks with respect to the eccentric of the power source of the apparatus.

A modified form of invention is shown in FIG. 3, wherein the neck 24' of the concave 12 is rectangular in cross section and wherein the spider 16' has webs 78' for supporting three separate dividers 14' side-by-side therein. The dividers 14' can be arranged to have a common cone member so as to prevent rock from passing down between the adjacent dividers without being subjected to blows by the hammers 40' of the various shanks. As illustrated in FIG. 3, each divider has a pair of diametrically opposed crushing members or shanks 35' which are adapted to successively move outwardly in diametrically opposite directions. Mounted in each divider 14' is a motor 56, an eccentric 65, a shaft 58 and flywheels 67,68 which, when activated, will rotate the eccentric (as shown in FIG. 4) to first drive the left-hand shank 35' and hammer 40' outwardly to crush the rock trapped between the hammer 40' and the neck 24' of the concave 12. The eccentric 65 continues on to activate the right-hand shank 35' to drive the hammer 40' outwardly to crush the rock between that hammer and the neck 24'. The plural dividers and hammers can be adjusted to randomly operate relative to each other to prevent all hammers on one side of the concave striking the rock simultaneously, thereby avoiding building up destructive harmonic forces in the apparatus.

What is claimed is:

1. A mechanically driven impact rock-crushing apparatus, comprising: a stationary member having an internal tubular vertically disposed wall defining an opening extending vertically therethrough, a divider carried by said stationary member and being disposed at the entry end of said opening, said divider having a cone-shaped portion centrally disposed with respect to said entry end of said opening, at least two shanks carried by said divider, each shank being pivoted at one end portion on said divider and having the other end portion extending downwardly in said vertically extending opening and being movable toward and away from said vertically disposed wall of said stationary member, an impact hammer carried by said other end portion of each shank, each impact hammer having a contact face substantially evenly spaced from said vertically disposed wall, a shaft rotatably mounted in said divider and having a vertical axis substantially coinciding with a vertical axis of said divider, a motor carried by said divider and being operatively connected with said shaft for rotating said shaft about said vertical axis, an eccentric mounted on said shaft said eccentric having a radially enlarged portion engaging each shank on each revolution of said eccentric, and flywheel means mounted on said shaft for rotation with said shaft and with said eccentric, said radially enlarged portion of said eccentric successively impacting said shanks to drive said impact hammers toward said vertically disposed wall of said stationary member to crush rocks between said contact faces of said impact hammers and said vertically disposed wall.

2. The rock-crushing apparatus as claimed in claim 1, wherein said stationary member has a converging open portion connected to said entry end of said vertically disposed wall, and wherein said cone-shaped portion of the divider is positioned in said converging open portion with said shanks extending down into said vertically extending opening.

3. The rock-crushing apparatus as claimed in claim 1, wherein said at least two shanks are mounted on diametrically opposite sides of said divider.

4. The rock-crushing apparatus as claimed in claim 1, wherein said shanks have impact rods aligned with said impact hammers and wherein said enlarged portion of the eccentric impacts radially against said impact rods to drive said impact hammers toward said vertically disposed wall of said stationary member, and wherein biasing and dampening means are operatively positioned between said divider and said shanks to resiliently urge said shanks and impact hammers outwardly and to dampen rebounding of said shanks.

5. The rock-crushing apparatus as claimed in claim 1, wherein said divider is supported centrally of said vertically extending opening by means of a spider member with webs extending between said vertically disposed walls and said divider and between adjacent ends of said impact hammers.

6. The rock-crushing apparatus as claimed in claim 1, wherein the inside surface of the walls of said stationary member and the contact surfaces of said impact hammers are replaceable.

7. The rock-crushing apparatus as claimed in claim 1, wherein said tubular vertically disposed walls are circular in cross section and said impact hammers substantially conform in shape to said circular shape of said vertically disposed walls.

8. The rock-crushing apparatus as claimed in claim 7, wherein said impact hammers substantially conform in shape to the shape of the tubular vertically disposed wall of the stationary member.

9. The rock-crushing apparatus as claimed in claim 1, wherein four shanks are mounted on said divider in equally spaced apart relationship.

10. The rock-crushing apparatus as claimed in claim 1, wherein the divider is comprised of at least two elements disposed side-by-side in said tubular vertically disposed wall and wherein each element has one pair of diametrically opposed impact hammers.

* * * * *